US008016214B2

(12) United States Patent
Higuma et al.

(10) Patent No.: US 8,016,214 B2
(45) Date of Patent: Sep. 13, 2011

(54) FUEL INJECTION VALVE AND METHOD FOR FORMING ORIFICE THEREOF

(75) Inventors: Masato Higuma, Hitachinaka (JP); Kenichi Gunji, Mito (JP); Keiji Kawahara, Hitachinaka (JP); Atsushi Sekine, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 110 days.

(21) Appl. No.: 12/194,221

(22) Filed: Aug. 19, 2008

(65) Prior Publication Data

US 2009/0242668 A1 Oct. 1, 2009

(30) Foreign Application Priority Data

Mar. 31, 2008 (JP) ..... 2008-089155

(51) Int. Cl.
*F02M 61/00* (2006.01)

(52) U.S. Cl. ..... 239/533.12; 239/552; 239/585.4; 239/585.5; 239/596; 239/601

(58) Field of Classification Search ..... 239/552, 239/533.12, 585.1, 585.4, 585.5, 596, 601
See application file for complete search history.

(56) References Cited

U.S. PATENT DOCUMENTS 5,163,621 A * 11/1992 Kato et al. ..... 239/533.12
6,669,116 B2 * 12/2003 Iwase ..... 239/533.12
6,826,833 B1 12/2004 Maier et al.
7,306,173 B2 * 12/2007 Pilgram et al. ..... 239/585.5
2004/0021014 A1 2/2004 Pilgram et al.
2007/0057093 A1 3/2007 Gunji et al.

FOREIGN PATENT DOCUMENTS

JP 55-152360 U 11/1980
JP 59-172273 U 11/1984
JP 2003-506626 A 2/2003
JP 2004-518904 A 6/2004
JP 2005-220774 A 8/2005
JP 2007-077843 A 3/2007

OTHER PUBLICATIONS

Japanese Office Action including partial English translation dated Mar. 2, 2010 (4 pages).
Japanese Office Action including partial English translation dated Jun. 15, 2010 (16 pages).

* cited by examiner

*Primary Examiner* — Steven J Ganey
(74) *Attorney, Agent, or Firm* — Crowell & Moring LLP

(57) ABSTRACT

A fuel injection valve comprises a convex portion prominently formed on an outer end surface of a nozzle body, stepped recesses each of which has plural steps formed by press forming on the convex portion, and multi orifices as fuel nozzle holes formed by press forming so that an outlet of each of the orifices is located at a bottom face of each of the stepped recesses. Furthermore, the fuel injection valve has plural sets each of which comprises one of the stepped recesses and the relevant orifice, the orifices incline to each other, and a step on a downstream side in each of the stepped recesses has a larger diameter than a step on an upstream side thereof.

33 Claims, 8 Drawing Sheets

FUEL INJECTION VALVE AND METHOD FOR FORMING ORIFICE THEREOF

CLAIM OF PRIORITY

The present application claims priority from Japanese patent application serial no. 2008-89155 filed on Mar. 31, 2008, the contents of which are hereby incorporated by reference into this application.

FIELD OF THE INVENTION

The present invention relates to a fuel injection valve used in an internal combustion engine of an automobile, and a method for forming orifices serving as a nozzle for the fuel injection valve.

BACKGROUND OF THE INVENTION

A fuel injection valve, wherein a convex portion is prominently formed in an orifice plate having orifices, plural recesses are formed at the convex portion, and an opening (outlet) of each of the orifices is formed at the bottom face of the relevant recess, has heretofore been known (for example refer to JP-A No. 77843/2007). In the fuel injection valve, the bottom face of a recess is formed perpendicularly to the axis line of the relevant orifice, consideration is made so that a fuel can be injected at the same time in a circumferential direction from outlets of the orifices. Further consideration, in forming process of the orifices, is made so that bending force may not be exerted on a punch when press forming is applied to a blank for the orifice plate. Further, a length of an orifice is adjusted by changing a depth of the relevant recess.

In the conventional technology, the functions of reducing the bending force exerted to a punch and adjusting the lengths of orifices are given by recesses each of which has only one step. As a result, press forming of orifices and recesses is restricted. For example, the angle between a punch and a press forming face cannot be largely deviated from 90 degrees or a thickness of the punch has to be used if it is attempted to largely deviate the angle. When deep recesses each of which has a large step are formed with a thickness of the punch, the work may weaken the strength of members used for the forming of the orifices.

When the strength of members forming orifices weakens in process of forming plural orifices and recesses, the next press forming is hardly applied to the succeeding orifices and recesses in some cases. Then, as the number of orifices increases, the degree of difficulty in press forming may increase and the degree of freedom in the design of orifices (a number, an inclination angle, an interval, etc.) may be restricted further.

Further, in the case where a large number of orifices are formed, when deep recesses of large diameters are intended to form, it is concerned that recesses of adjacent orifices and moreover a recess and an orifice may interfere with each other. In particular, when it is attempted to change an inclination angle of each orifice with respect to a center axis line of a fuel injection valve for each orifice and orient the orifices in desired directions, interference between recesses or between a recess and an orifice tends to occur among specific orifices. As a result, it is concerned that the degree of freedom in the design of orifices may reduce.

An object of the present invention is to increase the degree of freedom in design and the workability of orifices formed by press forming and used in a fuel injection valve.

SUMMARY OF THE INVENTION

In order to attain the above object, a fuel injection valve according to the present invention is configured as follows.

A fuel injection valve of the present invention comprises a convex portion prominently formed on an outer end surface of a nozzle body, stepped recesses each of which has plural steps formed by press forming on the convex portion, and multi orifices as fuel nozzle holes formed by press forming so that an outlet of each of the orifices is located at a bottom face of each of the stepped recesses. Furthermore, the fuel injection valve has plural sets each of which comprises one of the stepped recesses and the relevant orifice, the orifices incline to each other, and a step on a downstream side in each of the stepped recesses has a larger diameter than a step on an upstream side thereof.

Further, the following method for forming orifices as multi-nozzle holes of an injection valve is provided. The method is comprises of: a first press process of forming a first step-recess part in each of stepped recesses by applying extrusion processing or half-blank processing to a convex portion prominently formed on a blank from the convex portion-side; a second press process of forming a second step-recess part in each of the stepped recesses so that the second step-recess part has a smaller diameter than that of the first step-recess part by further applying extrusion processing or half-blank processing inside the first step-recess part; and a third press process of forming each of the orifices at a bottom face of the second step-recess part by extrusion processing, half-blank processing, or stamp processing. Furthermore, plural sets each of which comprises the first step-recess part, the second step-recess part, and the orifice aligned in the order are formed so that plural sets of the orifices incline to each other.

The present invention makes it possible to increase the degree of freedom in design and the workability of orifices formed by press forming, in a fuel injection valve.

DETAILED DESCRIPTION OF THE PREFERRED EMBODIMENTS

Figure 1:
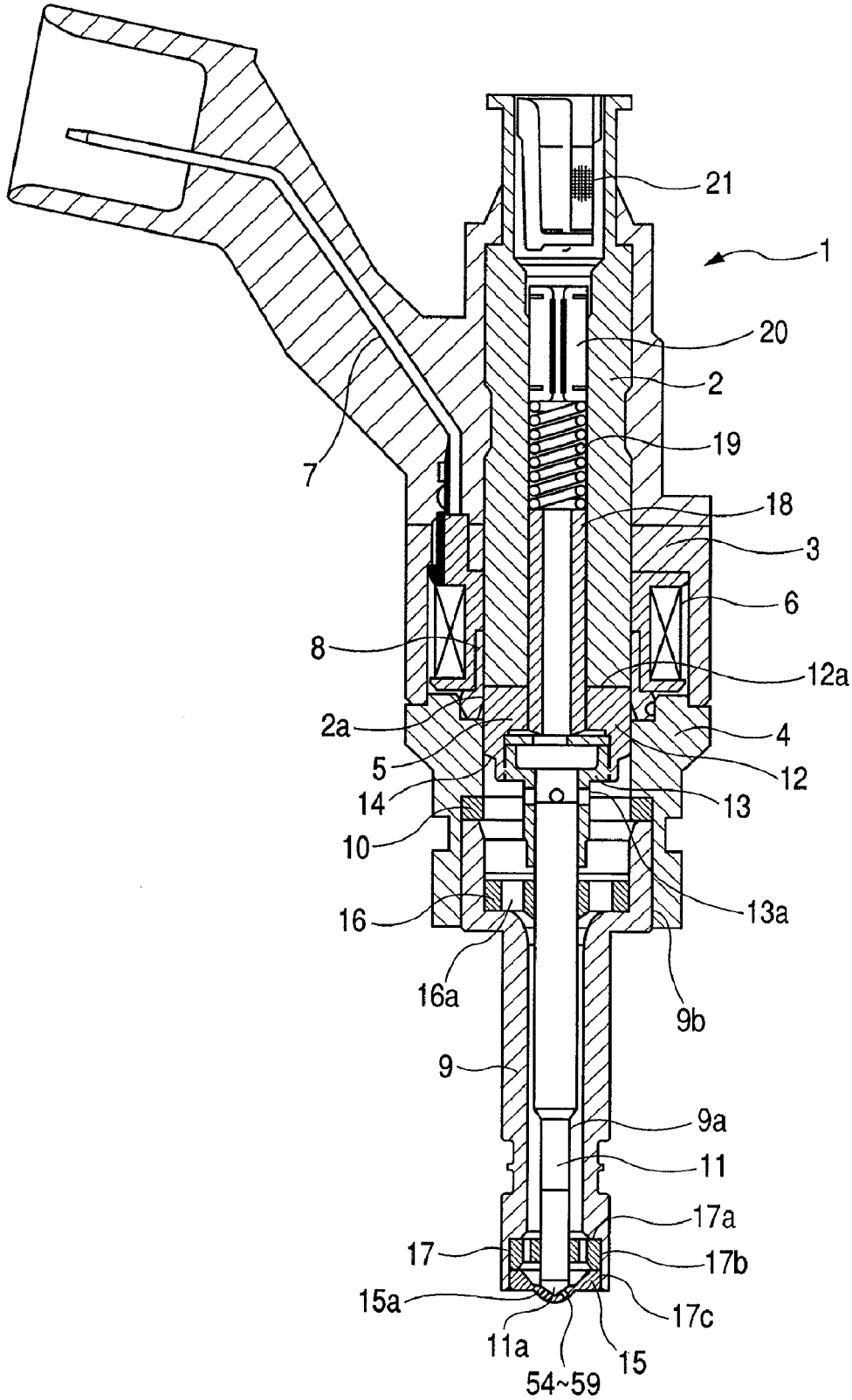
FIG. 1 is a vertical sectional view showing a whole configuration of an injection valve.

Embodiments according to the present invention are hereunder explained in detail in reference to drawings. FIG. 1 is a vertical sectional view showing a whole configuration of an injection valve according to an embodiment of the present invention. Here, the injection valve in the present embodiment is a fuel injection valve to inject a fuel such as gasoline and is used for injecting a fuel in the engine of an automobile.

A fuel injection valve assembly 1 comprises a magnetic circuit including a stationary core 2, a yoke 3, a housing 4 and a movable element 5, an electro magnetic coil 6 to energize the magnetic circuit, and a terminal bobbin 7 to supply electricity to the coil 6. A seal ring 8 is connected between the core 2 and the housing 4 and prevents a fluid such as a fuel from flowing into the coil 6.

Valve parts such as the movable element 5, a nozzle body 9, and a ring 10 to adjust a stroke of the movable element 5 are incorporated in the housing 4. The movable element 5 is formed by connecting a valve needle (valve element) 11 to a movable core 12 with a joint 13. A plate 14 is provided between the movable core 12 and the joint 13 to prevent the movable element 5 from bouncing jointly with a pipe 18 when the valve is closed.

An outer surface of the movable element 5 is surrounded by the housing 4 and nozzle body 9. The nozzle body 9 is provided with an orifice plate 15, a guide plate 16 and a guide plate 17. The orifice plate 15 has a nearly cone-shaped surface including a valve seat 15*a* and orifices 54-59. The guide plates 16 and 17 are to slidably guide the movable element 5 jointly with each other. The orifice plate 15 and guide plate B17 may be configured either as components separated from the nozzle body 9 respectively or as a single-piece construction integrated with the nozzle body 9.

Inside of the stationary hollow-core 2 is provided with a return spring 19, the pipe 18, a screw-adjuster 20 and a filter 21. The return spring 19 is to press the valve needle 11 against the valve seat 15*a* through the pipe 18 and the plate 14. The adjuster 20 is to adjust pressing load of the spring 19. The filter 21 is to prevent contaminants from intruding from outside.

Next, operations of the fuel injection valve 1 are explained in detail.

When electricity is supplied to the coil 6, the movable element 5 is pulled up toward the core 2 against the force of the spring 19 and a gap is formed between the movable side-valve seat 11*a* as a tip of the movable element 5 and the valve seat 15*a* (namely the valve is in the open state). A pressurized fuel goes through firstly the stationary core 2, the adjuster 20, and the pipe 18 and enters the nozzle body 9 via a fuel channel 13*a* in the movable element 5. Successively, the fuel passes through a channel 17*a* of the guide plate 17 through a fuel channel 16*a* of a guide plate 16 and a channel 9*a* of the nozzle, and then passes through the gap between the movable element 11 and the valve seat 15*a*, and injected to outside via orifices 54 to 59. The orifices 54 to 59 are formed respectively at different angles in the directions inclined with respect to a center axis line (hereunder referred to simply as an axis line) of the fuel injection valve.

When the electricity to the coil 6 is turned off, the tip 11*a* of the movable element 5 is pressed against to the valve seat 15*a* by the force of the spring 19 and the valve comes to a closed state.

Next, a configuration of the orifice plate 15 and the orifices 54 to 59 of the fuel injection valve 1 are explained in detail.

Figure 2:
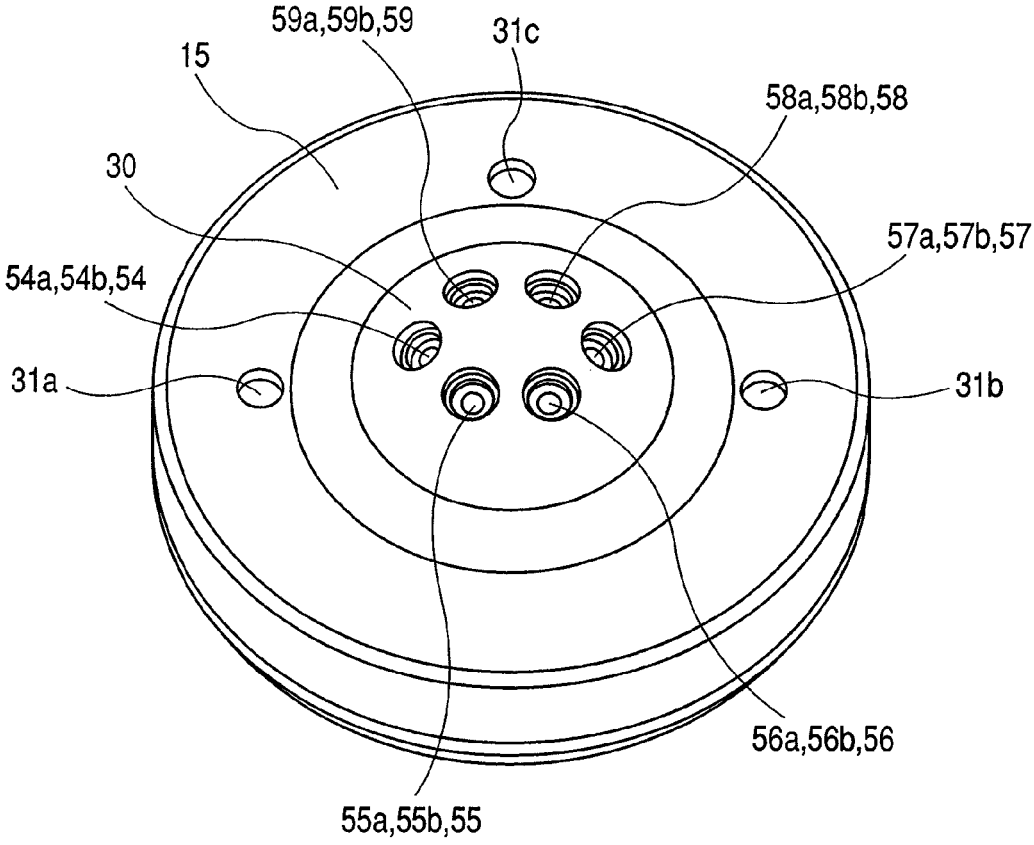
FIG. 2 is a perspective view of an orifice plate.
Figure 3:
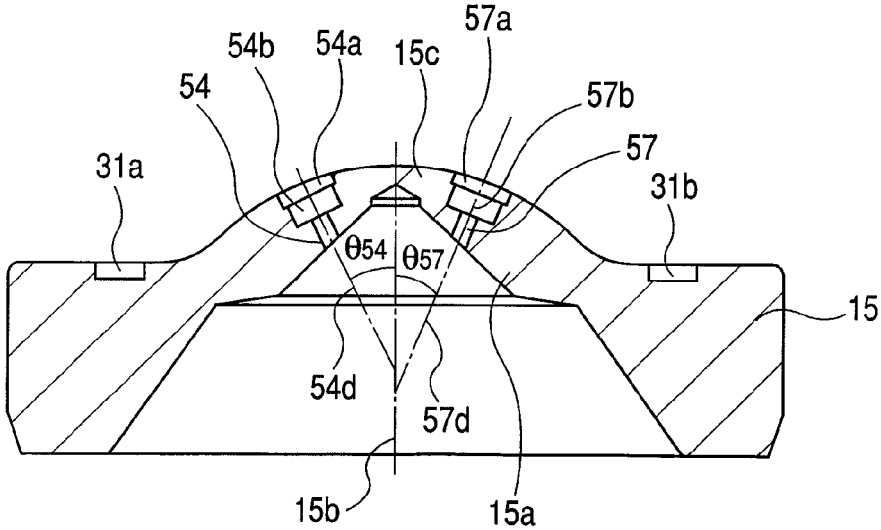
FIG. 3 is a vertical sectional view of an orifice plate.
Figure 4:
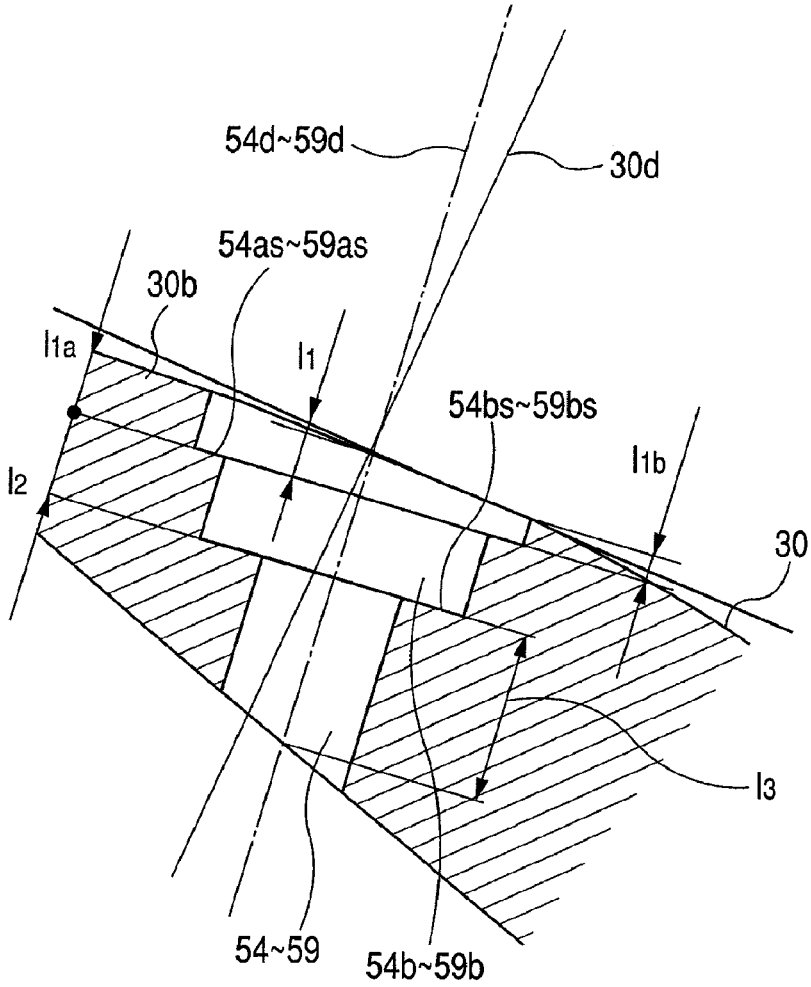
FIG. 4 is a partially enlarged view of the orifice plate shown in FIG. 3.

FIGS. 2, 3, and 4 represent an embodiment according to the present invention. FIG. 2 is a perspective view of the orifice plate 15, FIG. 3 is a vertical sectional view of the orifice plate 15, and FIG. 4 is a sectional view expansively showing a circumferential portion of an orifice shown in FIG. 3.

The orifice plate 15 comprises a disc-shaped metal plate. A spherical surface portion 30 as a convex portion is integrally formed with the orifice plate and prominently formed in the center of one end surface of the orifice plate 15. A nearly cone-shaped surface 15*a* including the valve seat is formed on the other surface of the orifice plate 15 opposite to the convex portion.

At the spherical surface portion 30 as the convex portion, orifices 54, 55, 56, 57, 58, and 59 used for fuel injection nozzle holes are formed in the directions of angles θ (refer to FIG. 3) with respect to the center axis line of the fuel injection valve (coinciding with the nozzle body-axis line 15*b*), namely in inclined directions. Here, in the present embodiment, the angles θ of the orifices are different from each other and each orifice is formed so as to be oriented in a desired direction. It goes without saying that the angles θ may be identical.

The valve needle 11 is provided on the upstream side from the orifices so as to make opening and closing movement jointly with the valve seat.

The fuel injection valve 1 is positioned in the rotation direction in relation to an electric terminal portion 7 and attached to an automobile. For that purpose, the orifice plate 15 has to be incorporated into the fuel injection valve 1 in a state where the orifice plate 15 is positioned in a rotation direction in relation to the terminal portion 7. However, the orifices 54, 55, 56, 57, 58, and 59 are formed at differently inclined angles with respect to the nozzle body-axis line 15*b* and hence they cannot be used for positioning the orifice plate 15 in the rotation direction. To cope with that, positioning recesses 31*a* and 31*b* are formed at places of 180 degrees apart from each other on a periphery of the spherical surface portion (convex portion) of the orifice plate 15. By so doing, a straight line linking two recesses 31 and 31*b* as two points 31*b* is formed and hence it is possible to incorporate the orifice plate 15 into the injection valve 1 in the state where the orifice plate 15 is positioned in the rotation direction in relation to the terminal portion 7. Further, a model type identifying recess 31*c* is formed between the recesses 31*a* and 31*b* on the periphery of the spherical surface portion (convex portion) 30. A model type can be easily identified by changing the position of the recess 31*c*, the diameter of the recess 31*c*, or the shape of the recess 31*c*(for example, a conical shape).

As stated above, it is possible to inject a fuel in desired directions by forming the orifices 54, 55, 56, 57, 58, and 59 at angles different from each in the directions inclined with respect to the nozzle body axis line 15*b* and hence, by changing the directions of the injection, it is possible to form fuel various splay patterns corresponding to combustion concepts conforming to engine specifications of each manufacturer. For example, by injecting a fuel so as to keep away from an intake valve and allow the fuel to localize around an ignition plug, it is possible to uniformly inject the fuel in a combustion chamber and produce a gas mixed with air very ideally without atomization hindered.

A group A of nearly circular recesses 54*a*, 55*a*, 56*a*, 57*a*, 58*a*, and 59*a* each of which is to be a first-step recess part are formed on the spherical surface portion (convex portion) 30-side on the downstream from the orifices 54, 55, 56, 57, 58, and 59 as shown in FIG. 3. A group B of nearly circular recesses 54*b*, 55*b*, 56*b*, 57*b*, 58*b*, and 59*b* each of which is to be a second step-recess part and has a smaller diameter than that of relevant the first step-recess part group A (54*a*, 55*a*, 56*a*, 57*a*, 58*a*, and 59*a*) are formed at the bottom faces of the first step-recess part group A respectively on the upstream from the first step-recess part group A. Namely, the second step-recess part group B is positioned between the first step-recess part group A and the orifices. Therefore, each of the recesses has two steps as a whole. Consequently, each of the second step-recess parts (54*b* to 59*b*) is formed inside the relevant each of the first step-recess parts (54*a* to 59*a*) and each of the stepped recesses comprises each of the first step-recess parts and the relevant each of the second step-recess parts.

Further, each of bottom faces 54*as* to 59*as* of the first step-recess parts A (56*a* to 59*a*) and each of bottom faces 54*bs* to 59*bs* of the second step-recess parts B (56*b* to 59*b*) are formed so that the faces may intersect nearly perpendicularly with the center axis line of the relevant orifice. Further, the center axis line of each of the first step-recess parts A (54*a* to 59*a*) and the relevant each of the second step-recess parts B and the center axis line of the relevant orifice are aligned so as to form a nearly straight line. Here, as shown in FIG. 4, the depth 11 of each of the first step-recess parts A (54*a* to 59*a*) is smaller than the length 13 of each of the orifices (54 to 59) and also the depth 12 of each of the second step-recess parts B (54*b* to 59*b*). Further, the depth of each of the first step-recess parts A (54*a* to 59*a*) varies in the circumferential direction and thus one depth 11*a* of each of the first step-recess parts A (54*a* to 59*a*) is different from the others 11*b* of the same first step-recess part. On the other hand, the depth of each of the second step-recess part B is nearly constant in the circumferential direction thereof.

In the present embodiment, the first step-recess parts A (54*a* to 59*a*) are formed on the curved surface (the spherical surface) of the convex portion 30. It is also possible to form planar surfaces each of which has a larger diameter than the relevant each of the first step-recess parts A (54*a* to 59*a*) on the spherical surface of the convex portion 30 beforehand and form each of the first step-recess parts A on the relevant each of the planar surfaces.

Further, as shown in FIG. 3, an angle θ54 between the center line 54*d* of the orifice 54 and the nozzle body axis line 15*b* (coinciding with the valve axis line in the present embodiment) is different from an angle θ57 between the center line 57*d* of the orifice 57 and the nozzle body axis line 15*b*. The angles θ of all the orifices 54, 55, 56, 57, 58, and 59 with respect to the nozzle body axis line may be different from each other or it is also possible to divide them into groups and different the angles θ of the groups from each other. Further, although the angles θ of all the orifices may be equalized, the present embodiment is particularly effective when the orifices have different angles θ as it will be stated later.

Each of the orifices 54, 55, 56, 57, 58, and 59 has an outlet (outlet side opening) formed at the bottom of the relevant each of the second step-recess parts B (54*b* to 59*b*) in the convex portion 30 and an inlet (inlet side opening) formed at the nearly cone-shaped surface including the valve seat 15*a*.

The length of an orifice as fuel nozzle hole has an influence on the length of a penetration of injected fuel. It is possible to optimize the length of each of the orifices 54 to 59 by changing the desired depth of each of the second step-recess portion parts B (54*b* to 59*b*), thereby being able to optimize the shape of injected fuel spray. In addition, it is possible to improve workability for the orifices. Consequently, the second step-recess parts B (54*b* to 59*b*) of at least two orifices have the depths different from each other. On this occasion, it is not necessary to change the thickness of the orifice plate tip 15*c* and hence the rigidity of the orifice plate 15 is not hindered. For that reason, the present embodiment is suitable for an injection valve of a high fuel pressure type wherein the pressure on the orifice plate tip 15*c* is as high as 10 MPa or more.

In the case where each of the orifices is formed at the concave portion so that the inlet thereof is opened on the cone-shaped surface including the valve seat like the present embodiment, the thickness of the member in which the orifices are formed is thicker than the case of forming orifices in a tabular member having uniform thickness. In particular, when inlets of the orifices are located on a circumference around the nozzle body axis line 15*b* (coinciding with the center axis line of the fuel injection valve) and the inclination angles θ of the orifices with respect to the nozzle body axis line 15*b* are different from each other, the outlets of the orifices are not aligned on the circumference around the nozzle body axis line 15*b*. On this occasion, the distances of the paths in the orifices are different from each other and resultantly the lengths of the orifices are varied. Consequently, it comes to be important to adjust the lengths of the orifices with the second step-recess portions B particularly in such a situation. However, when the function of reducing the bending stress exerting on a punch for press and the function of adjusting the lengths of orifices are given to the a recess, it comes to be difficult to freely change the depths of the recesses. In the present embodiment, the function of reducing the bending stress exerting on the punch is given to the first step-recess parts A (54*a* to 549) and separated from the function the second step-recess parts B (54*b* to 549) of adjusting the lengths of the orifices. By so doing, it is possible to realize recesses and orifices having good workability (having a high degree of freedom) with a high degree of machining accuracy.

Incidentally, the bending stress exerting on a punch increases as the angle between the punch and the processed surface is more deviated from 90 degrees. On this occasion, even though a thickness of the punch is used in consideration of the bending stress exerting on the punch, it is possible to prevent the strength of the member used for the processing of orifices from deteriorating since the steps of the first step-recess parts A having large diameters are low (the depths are shallow). It is possible to improve workability even during processing since the strength of the member used for the processing of orifices can be kept high during press forming.

Further, when a large number of orifices is formed, since the depths of the recesses having larger diameters are shallow, it is possible to prevent adjacent recesses and moreover a recess and an orifice from interfering with each other. In particular, even when the inclination angles θ of the orifices with respect to the nozzle body axis line 15*b* are different from each other and the orifices are oriented in desired directions, it is possible to prevent recesses and a recess and an orifice in specific orifices from interfering with each other. Furthermore, it is possible to increase the degree of freedom in the design of orifices and workability.

The present embodiment is effective also in the case of increasing the plate thickness in order to raise the strength of the orifice plate.

By the above measures, the outlets of the second step-recess parts B (54*b* to 59*b*) and the outlets of the orifices are perpendicular to the axis lines of the orifices respectively and hence the timing of fluid injection is equalized over the whole circumference. Consequently, it is possible to equalize the length of the penetration of the fuel injection and improve the evenness of fuel spray even with the orifices deflected from the nozzle axis line 15*b*. On this occasion, the depths of the first step-recess parts A (54*a*-59*a*) are sufficiently lower than the depths of the second step-recess portions B and hence the recesses A do not influence the fuel injection spray.

Next, a method for forming an orifice plate 15 is explained in reference to FIGS. 5 to 17.

Figure 5:
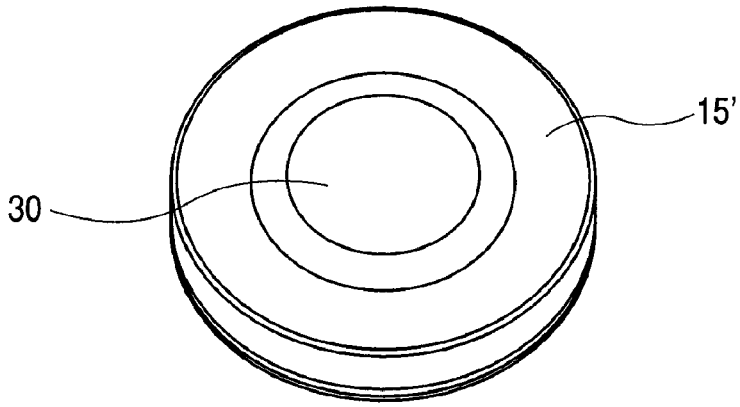
FIG. 5 is a perspective view of a blank.
Figure 6:
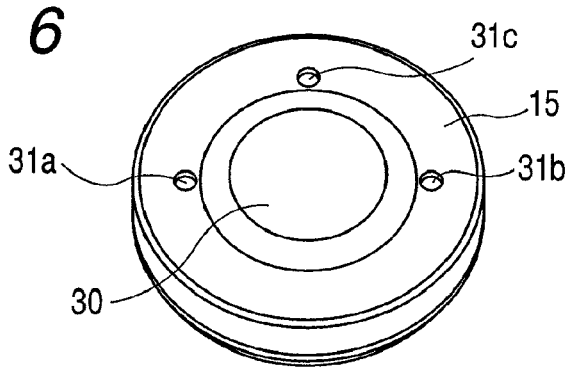
FIG. 6 is a perspective view of an orifice plate on which positioning holes are formed.
Figure 7:
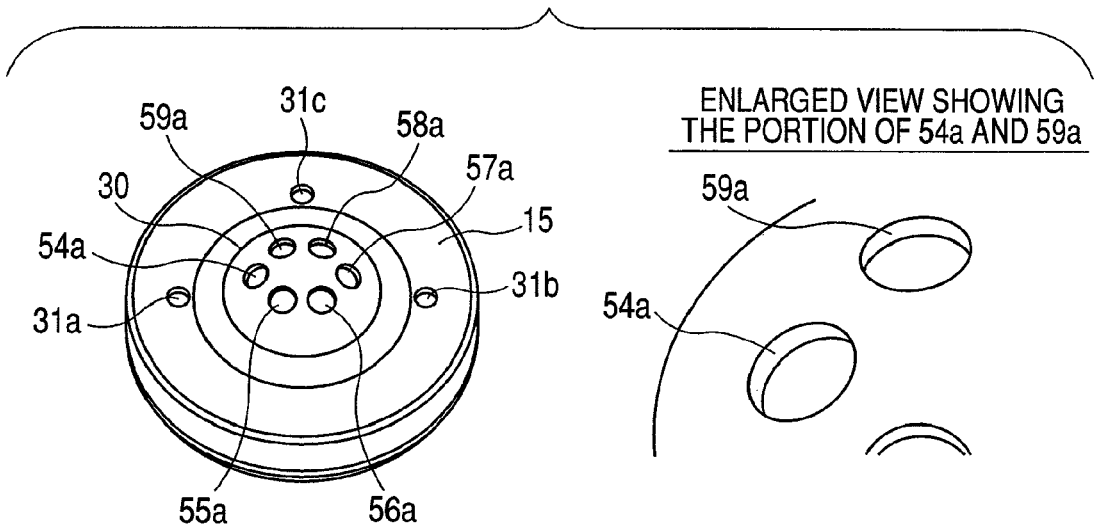
FIG. 7 is a perspective view of an orifice plate on which a group A of first step-recess parts (54*a*-59*a*) are formed, and an enlarged view showing a part thereof.
Figure 8:
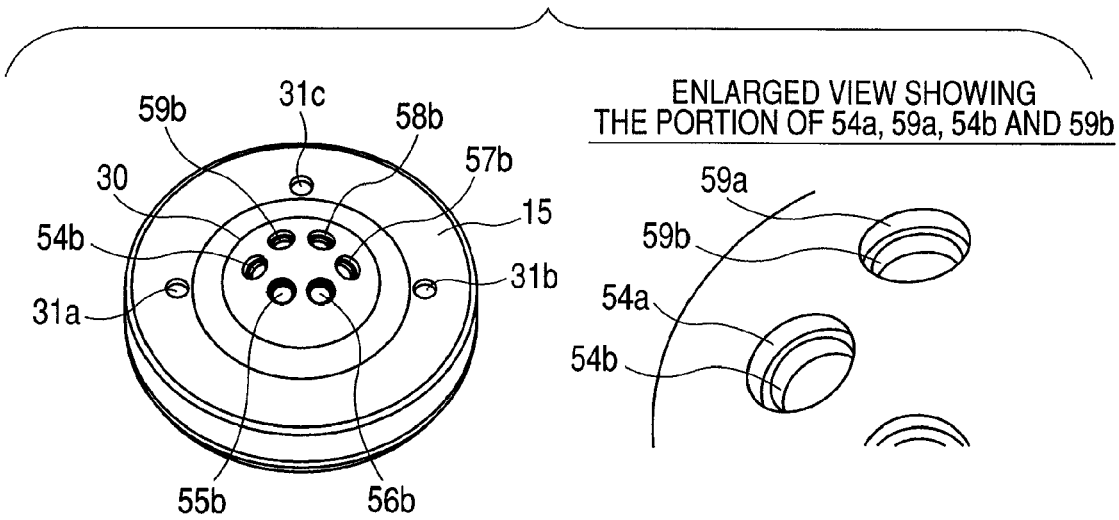
FIG. 8 is a perspective view of an orifice plate on which a group A of first step-recess parts (54*a*-59*a*) and a group B of second step-recess parts (54*b*-59*b*) are formed, and an enlarged view showing a part thereof.
Figure 9:
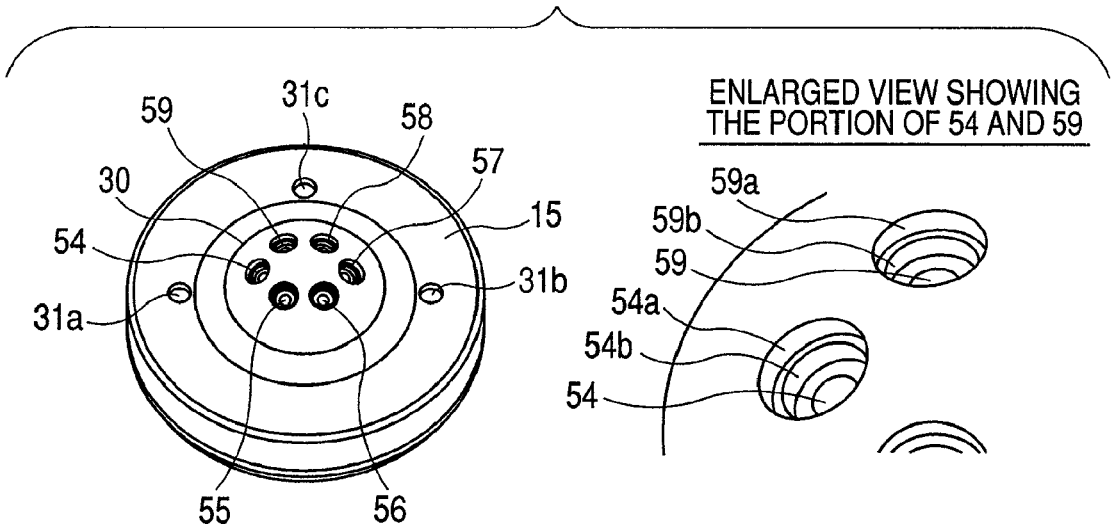
FIG. 9 is a perspective view of an orifice plate on which the group A of first step-recess parts (54*a*-59*a*), the group B of second step-recess parts (54*b*-59*b*) and orifices are formed, and an enlarged view showing a part thereof.
Figure 10:
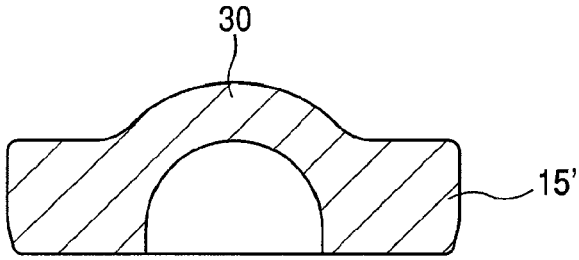
FIG. 10 is a vertical sectional view of a blank.
Figure 11:
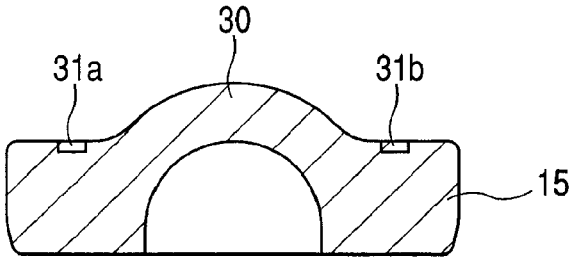
FIG. 11 is a vertical sectional view of an orifice plate on which positioning holes are formed.
Figure 12:
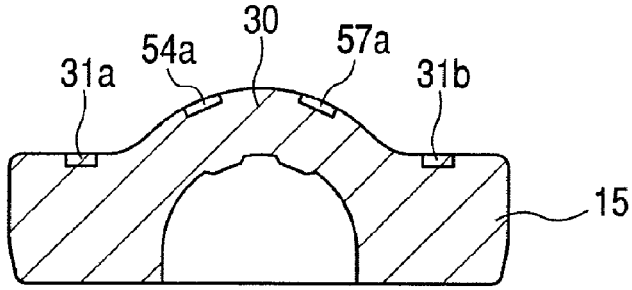
FIG. 12 is a vertical sectional view of an orifice plate on which the group A of first step-recess parts is formed.
Figure 13:
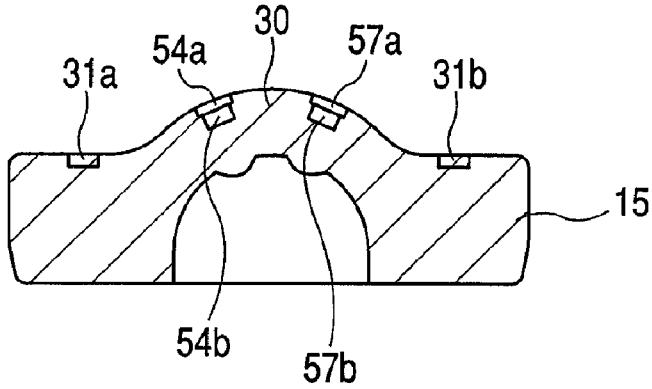
FIG. 13 is a vertical sectional view of an orifice plate on which the group A of first step-recess parts and the group B of second step-recess parts are formed.
Figure 14:
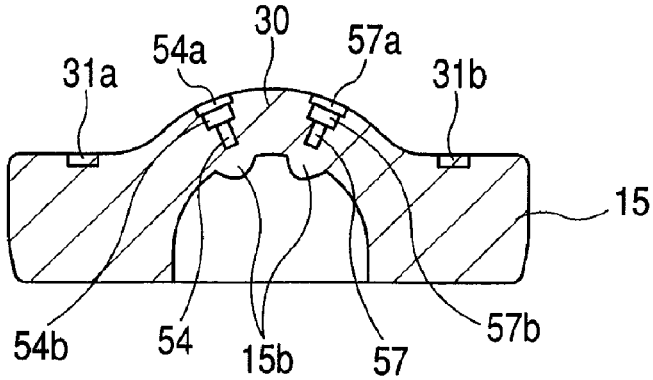
FIG. 14 is a vertical sectional view of an orifice plate on which the group A of first step-recess parts and the group B of second step-recess parts, and orifices are formed.
Figure 15:
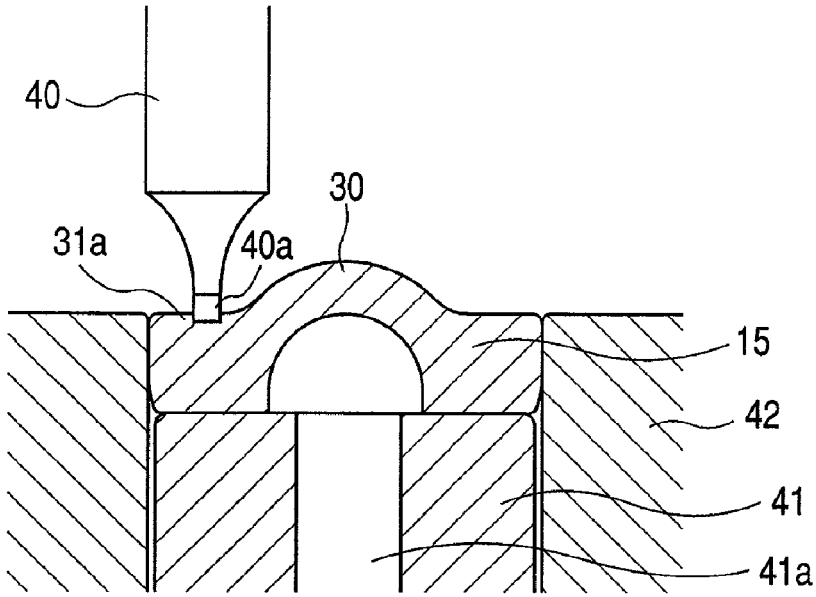
FIG. 15 is a view showing a process of forming a positioning recess 31*a;*
Figure 16:
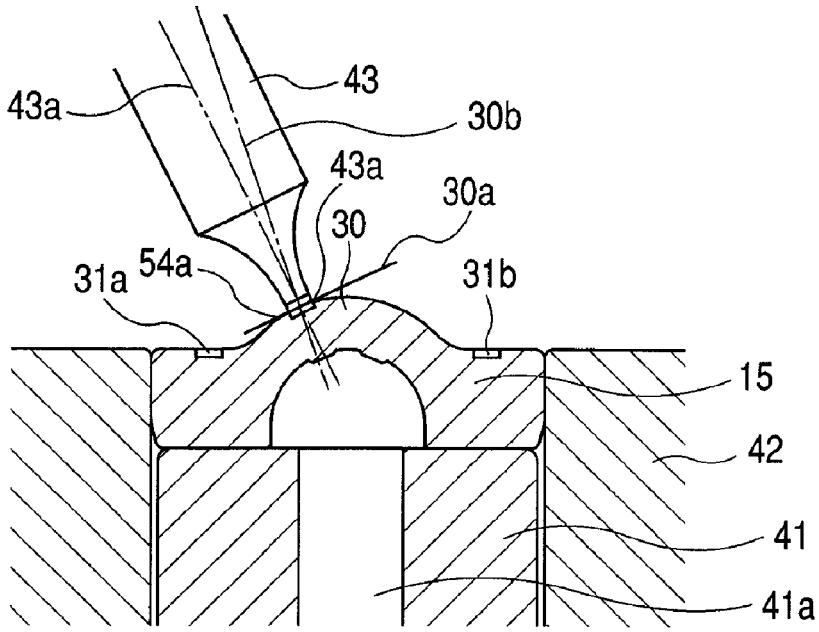
FIG. 16 is a view showing a process of forming the group A of first step-recess parts.
Figure 17:
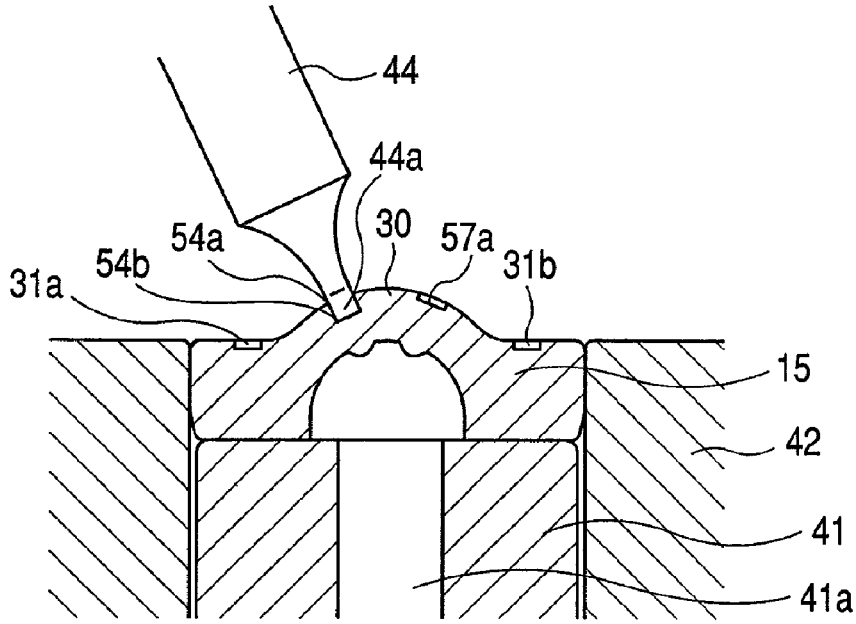
FIG. 17 is a view showing a process of forming the group B of second step-recess parts.
Figure 18:
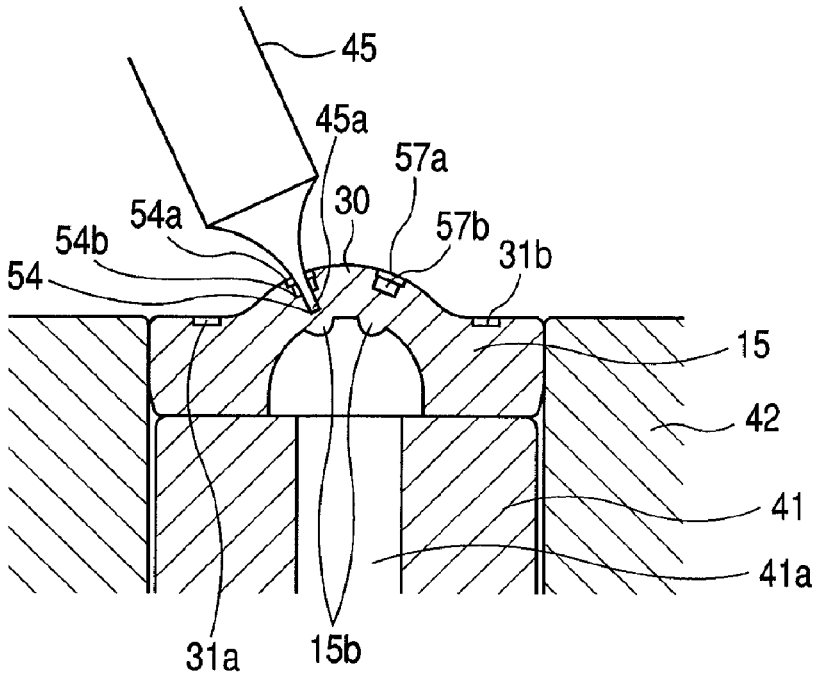
FIG. 18 is a view showing a process of forming an orifice.

FIG. 5 is a perspective view of a blank 15'. FIG. 6 is a perspective view of an orifice plate on which a positioning recess 31*a* is formed. FIG. 7 comprises perspective views of an orifice plate on which the first step-recess parts A (54*a* to 59*a*) are formed. FIG. 8 comprises perspective views of an orifice plate on which the first step-recess parts A (54*a* to 59*a*) and second step-recess parts B (54*b*-59*b*) are formed. FIG. 9 comprises perspective views of an orifice plate on which the first step-recess parts A (54*a* to 59*a*), second step-recess parts B (54*b*-59*b*), and orifices are formed. FIG. 10 is a vertical sectional view of a blank 15'. FIG. 11 is a vertical sectional view of an orifice plate on which a positioning recess 31*a* is formed. FIG. 12 is a vertical sectional view of an orifice plate on which the first step-recess parts A (54*a* to 59*a*) are formed. FIG. 13 is a vertical sectional view of an orifice plate on which the first step-recess parts A (54*a* to 59*a*) and second step-recess parts B (54*b*-59*b*) are formed. FIG. 14 is a vertical sectional view of an orifice plate on which the first step-recess parts A (54*a* to 59*a*), second step-recess parts B (54*b*-59*b*), and orifices are formed. FIG. 15 is a view showing the state of forming a positioning recess 31*a*. FIG. 16 is a view showing the state of forming a recess A. FIG. 17 is a view showing the state of forming a recess B. FIG. 18 is a view showing the state of forming an orifice.

Firstly, the orifice plate 15 is formed by cutting the nearly disc-shaped blank 15' having the spherical surface portion (convex portion) 30 in the center of a surface as shown in FIGS. 5 and 10. Further, a cup-shaped concave is formed on the opposite side surface of the spherical surface portion 30 of the blank 15'.

Next, as shown in FIG. 15, the blank 15' on which the spherical surface portion 30 is formed is placed on an upper face of a die 41 and the outer circumference is firmly retained with a collet chuck 42. Further, the periphery of the spherical surface portion (convex portion) 30 is pressed with a cutting blade 40*a* of a punch 40 and a positioning recess 31*a* is formed while the blank 15' is retained. A positioning recess 31*b* and a model type identifying recess 31 care formed in the same manner. By forming the positioning holes 31*a* and 31*b* and the model type identifying recess 31*c* by applying press forming to the blank 15' in this way, it is possible to obtain an orifice plate 15 having the positioning recesses 31*a* and 31*b* and the model type identifying recess 31*c* at the three places on the outer circumference side of the spherical surface portion 30 as shown in FIGS. 6 and 11.

Next, as shown in FIG. 16, the spherical surface portion 30 is pressed with a cutting blade 43*a* of a punch 43 and the first step-recess part 54*a* is formed into a sac hole shape by extrusion processing while the orifice plate 15 is retained with the collet chuck 42. The remaining first step-recess parts 55*a*, 56*a*, 57*a*, 58*a* and 59*a* are processed in the same manner but the order of the processing is appropriately determined in accordance with the deflected direction of each orifice. Here, it is desirable that the press forming of the first step-recess parts A (54*a* to 59*a*) can harden the surface at the same time. As stated above, by press-forming the first step-recess parts A (54*a* to 59*a*) on the orifice plate 15, first step-recess parts A (54*a* to 59*a*) of good surface roughness each of which has a plane nearly perpendicular to the center axis line of the relevant first step-recess part can be formed on the spherical surface portion 30 as shown in FIGS. 7 and 12.

Next, as shown in FIG. 17, the bottom face of the first step-recess part 54*a* is pressed with a cutting blade 44*a* of a punch 44 from the same direction as the punch 43 used for the forming of the first step-recess, and then the second step-recess 54*b* is formed into a sac hole shape by extrusion processing while the orifice plate 15 is retained with the collet chuck 42. The remaining second step-recess parts 55*b*, 56*b*, 57*b*, 58, and 59*b* are processed in the same manner but the order of the processing is appropriately determined in accordance with the deflected direction of each orifice. Here, it is desirable that the press forming of the second step-recess parts B (54*b*-59*b*) can harden the surface at the same time. As stated above, by press forming the second step-recess parts B (54*b*-59*b*) on the orifice plate 15, it is possible to obtain the orifice plate 15 having second step-recess parts B (54*b*-59*b*) of good surface roughness at the bottom faces of the relevant first step-recess parts A (54*a* to 59*a*) as shown in FIGS. 8 and 13.

The surface of the stepped recesses is hardened by press-forming the first step-recess parts A (54*a* to 59*a*) and the second step-recess parts B (54*b*-59*b*) and hence it is possible to process the edges of the second step-recess parts B (54*b*-59*b*) and the orifices beautifully with a high degree of accuracy.

Further, since both the punch 43 for forming the first step-recess parts A (54*a* to 59*a*) and the punch 44 for forming the second step-recess parts B (54*b*-59*b*) pressed from the same directions and in particular the bottom face of each of the first step-recess parts A (54*a* to 59*a*) is already nearly perpendicular to the center axis line of the relevant first step-recess part, the material flows evenly in the circumferential direction. As a result, it is possible to align the center axis line of each of the first step-recess parts A (54*a* to 59*b*) and the center axis line of the relevant each of the second step-recess portion B nearly on the identical straight line. Further it is possible to keep the bottom face of each of the second step-recess parts B (54*b* to 59*b*) more accuracy perpendicular to the center axis lines of the relevant each of the first step-recess parts A (54*a* to 59*a*) and the second step-recess parts B (54*b* to 59*b*) than the bottom face of the first step-recess part A (54*a* to 59*a*).

As the punch 43 for forming the first step-recess parts A (54*a* to 59*a*), a punch having a larger diameter than the punch 44 for forming the second step-recess parts B (54*b*-59*b*) can be used. Further, the depth of each of the first step-recess parts A (54*a* to 59*a*) is shallower than the depth of the relevant second step-recess parts B (54*b* to 59*b*). As a result, as shown in FIG. 16, the punch 43 is less likely to break even when press forming is applied to the spherical surface portion 30 in the state of inclining the punch 43 with respect to the vertical line 30*b* of the virtual plane 30*a* tangent to the spherical surface portion 30 at the place where each of the first step-recess parts A is press-formed.

Next, as shown in FIG. 18, a cutting blade 45*a* of a punch 45 is pressed perpendicularly to the bottom face of the second step-recess part 54*b* and the orifice 54 is formed into a sac hole shape by extrusion processing while the orifice plate 15 is retained with the collet chuck 42. The remaining orifices 55, 56, 57, 58, and 59 are processed in the same manner but the order of the processing is appropriately determined in accordance with the deflected direction of each orifice. As stated above, by press-forming the orifices on the orifice plate 15, it is possible to obtain the orifice plate 15 having orifices on the bottom faces of the relevant second step-recess parts B (54*b*-59*b*) as shown in FIGS. 9 and 14. Here, since the orifice plate 15 is in the state of being retained with the collet chuck 42, it is possible to process the orifice plate 15 with a high degree of positional accuracy so that the center axis lines of each of the first step-recess parts A (54*a* to 59*b*), the relevant each of the second step-recess parts B (54*b* to 59*b*), and the relevant orifice may form a nearly straight line on the basis of the positioning recesses. In addition, since each of the orifices is press-formed into sac hole shape, it is possible to form the whole inner surfaces into sheared surfaces and considerably improve the surface roughness.

A problem here is that, when an orifice is deflected from the direction of the normal to the spherical surface portion 30, a punch undergoes uneven load during the forming of each of the first step-recess parts A (54*a* to 59*a*), bending load is imposed on the cutting blade 43*a* of the punch 43, and the punch 43 is damaged. By the present invention however, since the length of the cutting blade 43*a* of the punch 43 is shorter than the length of the cutting blade 45*a* of the punch 45 and the diameter of the cutting blade 43*a* is larger than the diameter of the cutting blade 45*a*, it is possible to enhance bending stiffness and form a planar portion nearly perpendicular to the orifice axis line without the punch 43 damaged even when bending load is imposed during processing. Further, during the succeeding processes of forming the second step-recess parts B (54*b*-59*b*) and the orifices, bending loads are not imposed on the cutting blade 44*a* of the punch 44 and the cutting blade 45*a* of the punch 45 and hence it is possible to press-form the second step-recess parts B (54*b*-59*b*) and the orifices with a high concentricity without the punches 44 and 45 damaged. Furthermore, the axis line of each of the orifices intersects nearly perpendicularly with the bottom face of each of the relevant the first step-recess parts A which is located at the exit of the relevant each of the second-step recess parts B and the bottom face of the relevant each of the second step-recess parts B which is located at the exit of the relevant orifice but it is also possible to form the bottom face of each of the second step-recess parts B so as to intersect more perpendicularly than the bottom face of each of the first step-recess parts A.

In the present embodiment, the diameters of the first step-recess parts A (54*a* to 59*a*), the second step-recess parts B (54*b*-59*b*), and the orifices decrease in this order. Consequently, the diameters of the punches used for the press forming of the portions also decrease in the order of the punch 43 for the first step-recess parts A (54*a* to 59*a*), the punch 44 for the second step-recess parts B (54*b*-59*b*), and then the punch 45 for the orifices. On the other hand, the forming depths increase in the order of the orifices (54 to 59), the second step-recess parts B (54*b* to 59*b*), and the first step-recess parts A (54*a*-59*a*). The punch 43 for the first step-recess parts A (54*a* to 59*a*) susceptible to the largest bending stress has a larger diameter and a shallower forming depth and hence the durability the punch improves.

In the case where inlets of the orifices are opened on the cone-shaped surface including the valve seat like the present embodiment, the thickness of the member forming the orifices is thicker than the case of forming orifices on a tabular member having a uniform thickness. Consequently, it comes to be important to reduce a bending stress exerting on a punch and adjust the lengths of the orifices by forming stepped recesses such as the first step-recess parts A (54*a* to 59*a*) and the second step-recess parts B (54*b*-59*b*) particularly in such a situation. On this occasion, it is possible to realize recesses and orifices having good workability with a high degree of machining accuracy by giving the function of reducing the bending stress exerting on a punch to the first step-recess parts A (54*a* to 59*a*), giving the function of adjusting the lengths of the orifices to the second step-recess parts B (54*b*-59*b*), and thus separating the functions of the first step-recess parts A (54*a* to 59*a*) and the second step-recess parts B (54*b*-59*b*).

Finally, by forming each of the orifices into a sac hole, the extruded portion 15*b* formed at the concave on the opposite surface of the spherical surface portion 30 is cutout by forming the nearly cone-shaped surface 15*a* (the valve seat) as shown in FIG. 3 and the orifice penetrates to the side of the cone-shaped surface 15*a*. On this occasion, turning or electric discharging is used for the processing. By so doing, it is possible to form an orifice having the whole surface of which is a sheared surface. The flow rate of a fuel is susceptible to the diameter of an orifice at a constant pressure and the precise control of the orifice diameter is necessary for the control of the flowrate. By the present invention, the control is facilitated since the orifice diameter is controlled only by the control of a punch diameter. In contrast, an orifice formed by punching has a large diameter on the fractured surface, the length of the fractured surface varies, and hence the control of the orifice diameter is more difficult than the case according to the present invention. Further, when an orifice is formed by electric discharging, in addition to the control of the electrode diameter, processing conditions such as a processing speed and voltage must be controlled and the control of the orifice diameter is more difficult than the case according to the present invention.

In this way, by forming two-stepped recesses each of which has a plane nearly perpendicular to the center axis line of the relevant orifice at the spherical surface portion (convex) on the downstream side of the orifice, it is possible to easily form orifices having different injection directions by press forming with a high degree of accuracy. Consequently, even with a martensitic stainless steel (for example, SUS420J2) having a carbon content of 0.25% or more, it is possible to easily form a deep hole of an aspect ratio of 1.5 or more by pressing. Here, when a martensitic stainless steel having a carbon content of 0.25% or more is used, it is desirable that the hardness after quenching is not lower than 52 in HRC.

Further, since the outlet of each of the second step-recess parts B (54*b*-59*b*) and the outlet of the relevant orifice are formed on planes perpendicular to the axis line of the orifice, the injection timing of a fluid can be uniform over the whole circumference and it is possible to equalize the length of penetration and improve the homogeneity of injected fuel spray even with the orifices deflected (inclined) from the axis line of an injection valve.

Further, by changing the depths of the second step-recess parts B (54*b*-59*b*), it is possible to change the lengths of the relevant orifices and optimize the shape of injected fuel spray. On this occasion, since it is not necessary to change the thickness of the orifice plate tip 15*c*, the rigidity of the orifice plate 15 does not lower. For that reason, the present embodiment is suitable for an injection valve of a high fuel pressure type wherein the pressure on the orifice plate tip 15*c* is as high as 10 MPa or more.

Furthermore, since the depths of the first step-recess parts A (54*a* to 59*a*) are shallower than those of the relevant second step-recess parts B (54*b*-59*b*), the first step-recess parts A (54*a* to 59*a*) do not affect injected fuel spray.

Furthermore, by forming the first step-recess parts A (54*a* to 59*a*) on the spherical surface portion, bending load is not imposed on the punches during the forming of the second step-recess parts B (54*b*-59*b*) and the orifices and hence it is possible to press-form the second step-recess parts B (54*b*-59*b*) and the orifices with a high concentricity. Consequently, orifices of good surface roughness can be formed in comparison with the orifices formed by electric discharging or cutting, for example. As a result, it is possible to: reduce the amount of cinders, such as carbon produced by the combustion of a fuel when the fuel is injected into a cylinder, sticking to the first step-recess parts A (54*a* to 59*a*), the second step-recess parts B (54*b*-59*b*), and the orifices; and improve the fractionization, the shape, and the positional accuracy of atomization. In a running test of a real gasoline-powered vehicle, it is experimentally clarified that, in the case of a fuel injection valve using an orifice plate wherein the orifices are formed by electric discharging and each of the recesses has one step, cinders stick to the first step-recess parts A (54*a* to 59*a*) and the orifices and the flow rate lowers by 15% after the running of 30,000 km. In contrast, in comparison with a product by electric discharging, the concentricity and the surface roughness of the first step-recess parts A (54*a* to 59*a*), the second step-recess parts B (54*b*-59*b*), and the orifices of the present invention are good and hence it is possible to reduce the amount of cinders sticking to the first step-recess parts A (54*a* to 59*a*), the second step-recess parts B (54*b*-59*b*), and the orifices and control the variation of the flow rate to 1.7% or less.

Further, by positioning and forming the first step-recess parts A (54*a* to 59*a*), the second step-recess parts B (54*b*-59*b*), and the orifices while a blank is chucked, they can be positioned and formed at the processes with a high degree of accuracy without the necessity of positioning the plural orifices deflected from the axis line of an injection valve.

Furthermore, the method for press-forming orifices according to the present invention can reduce the processing time per hole up to about one thirtieth the processing time per hole in the method for processing orifices by electric discharging and hence it is possible to reduce the equipment investment and provide an orifice plate less expensive than a product by electric discharging.

Although the embodiments according to the present invention are concretely explained above, the present invention is not limited to the embodiments but may be variously modified within the range of the tenor of the present invention. For example, the explanations have been made on the premise that the region where the planar portion 33 is formed is the spherical surface portion 30 in the above embodiments, but the region may be a curved surface (a convex portion) other than a spherical surface.

Yet further, the spherical surface portion 30 of the blank 15' is formed by cutting in the above embodiments but may be formed by press forming such as forging.

Still further, although the orifices are formed by extrusion in the above embodiments, each of the orifices may be formed by cutting off the fractured surface of the orifice so as to have a whole sheared surface when the seat surface is formed by cutting or electric discharging from the upstream side after the orifice is formed by punching.

In the present embodiments, since the rigidity (strength) of the orifice plate 15 is never lowered during the press forming of the orifices and the stepped recesses up to the end of the processing, it is possible to facilitate the press forming and realize the method for producing a fuel injection valve and orifices with high mass-productivity.

Further, it is possible to prevent orifices and stepped recesses from interfering with each other between adjacent orifices and increase the degree of freedom in the design of orifices (for example, an inclination angle, an orientation, and others).

What is claimed is:

1. A fuel injection valve comprising:

a convex portion formed on an outer end surface of a nozzle body;

a stepped recess formed on said convex portion, which stepped recess has plural step-recess parts; and an orifice forming a fuel nozzle hole which is disposed so that an outlet of said orifice is located at a bottom of said stepped recess; wherein, said orifice is inclined relative to an axis of said nozzle body;

said stepped recess comprises a first step-recess part and a second step-recess part;

said first step-recess part and said second step-recess part are adjacent each other in a direction of an axis of said orifice, and are disposed such that a bottom of said first step-recess part forms a downstream face in a fuel traveling direction in said nozzle body, a bottom of said second step-recess part forms an upstream face in the fuel traveling direction, an opening of said first step-recess is formed on a convex surface of said convex portion, and an opening of said second step-recess part is formed on the bottom of said second step-recess part;

the bottoms of said first and second step-recess parts are respectively formed by surfaces that are substantially normal to the axis of said orifice;

said orifice is formed so that the outlet of said orifice opens the bottom of said second step-recess part; and height of said first step-recess part is less than that of said second step-recess part.

2. The fuel injection valve according to claim 1 wherein said convex portion has a spherical surface.

3. The fuel injection valve according to claim 1, wherein a center axis line of said orifice is deflected from a direction of a normal to said convex portion.

4. The fuel injection valve according to claim 1, wherein the bottoms of said first and second step-recess parts form flat surfaces.

5. The fuel injection valve according to claim 1, wherein said first and second step-recess parts are formed by pressing.

6. A fuel injection valve comprising:

a convex portion formed on an outer end surface of a nozzle body;

a stepped recess formed on said convex portion, which stepped recess has plural step-recess parts; and an orifice forming a fuel nozzle hole which is disposed so that an outlet of said orifice is located at a bottom of said stepped recess; wherein, said orifice is inclined relative to an axis of said nozzle body;

said stepped recess comprises a first step-recess part and a second step-recess part;

said first step-recess part and said second step-recess part are adjacent each other in a direction of an axis of said orifice, and are disposed such that a bottom of said first step-recess part forms a downstream face in a fuel traveling direction in said nozzle body, a bottom of said second step-recess part forms an upstream face in the fuel traveling direction, an opening of said first step-recess is formed on a convex surface of said convex portion, and an opening of said second step-recess part is formed on the bottom of said second step-recess part;

the bottoms of said first and second step-recess parts are respectively formed by surfaces that are substantially normal to the axis of said orifice;

said orifice is formed so that the outlet of said orifice opens the bottom of said second step-recess part;

said fuel injection valve has plural sets each of which comprises said stepped recess and said orifice;

said orifices are inclined relative to each other; and respective first step-recess parts of at least two of said plural stepped recesses have heights that differ from each other.

7. The fuel injection valve according to claim 6, wherein respective angles between center axis lines of at least two of said plural orifices and the axis line of said nozzle differ from each other.

8. The fuel injection valve according to claim 6, wherein said convex portion has a spherical surface.

9. The fuel injection valve according to claim 6, wherein a center axis line of said orifice is deflected from a direction of a normal to said convex portion.

10. The fuel injection valve according to claim 6, wherein the bottoms of said first and second step-recess parts form flat surfaces.

11. The fuel injection valve according to claim 6, wherein said first and second step-recess parts are formed by pressing.

12. A fuel injection valve comprising:

a valve needle incorporated in a nozzle body so as to be movable in an axial direction of said nozzle;

a valve seat on which said valve needle seats, said valve seat being formed on a substantially cone-shaped surface inside said nozzle body;

a convex portion formed on an outer surface of said nozzle body, opposite said cone-shaped surface; and plural stepped recesses each of which comprises a first step-recess part and a second step-recess part; wherein, said first step-recess part and said second step-recess part are adjacent each other in a direction of an axis of said orifice and are disposed such that, as between said first step-recess part and said second step-recess part, a bottom of said first step-recess part forms a downstream face in a fuel flowing direction in said nozzle body, a bottom of said second step-recess part forms an upstream face in the fuel flow direction, an opening of said first step-recess part is formed on a convex surface of said convex portion, and an opening of said second step-recess part is formed on the bottom of said first step-recess part;

plural orifices are formed as fuel nozzle holes such that an outlet of such orifice is located at a bottom of each respective stepped recess, and an inlet thereof is located on said cone-shaped surface;

the bottoms of said first and second step-recess parts are respectively formed by surfaces that are substantially normal to the axis of said orifices;

each orifice is formed so that an outlet of said orifice opens on the bottom of said second step-recess part;

a height of said second step-recess part is larger than that of said first step-recess part;

an axial length of said orifice is larger than the height of said second step-recess part;

at least one of said plural orifices inclines relative to a center axis line of said fuel injection valve, at an inclination angle that differs from inclination angles of the other orifices;

in at least one of said plural stepped recesses, a height of said first step-recess part varies in a circumferential direction of said first step-recess part, and a height of said second step-recess part is substantially constant in the circumferential direction of said second step-recess part.

13. The fuel injection valve according to claim 12, wherein inlets of said plural orifices are located on said cone-shaped surface on a circumference around a center axis line of said fuel injection valve.

14. The fuel injection valve according to claim 12, wherein the bottoms of said first and second step-recess parts form flat surfaces.

15. The fuel injection valve according to claim 12, wherein said first and second step-recess parts are formed by pressing.

16. A fuel injection valve comprising:

a convex portion formed on an outer end surface of a nozzle body;

a stepped recess formed on said convex portion, which stepped recess has plural step-recess parts; and an orifice forming a fuel nozzle hole which is disposed so that an outlet of said orifice is located at a bottom of said stepped recess; wherein, said orifice is inclined relative to an axis of said nozzle body;

said stepped recess comprises a first step-recess part and a second step-recess part;

said first step-recess part and said second step-recess part are adjacent each other in a direction of an axis of said orifice, and are disposed such that a bottom of said first step-recess part forms a downstream face in a fuel traveling direction in said nozzle body, a bottom of said second step-recess part forms an upstream face in the fuel traveling direction, an opening of said first step-recess is formed on a convex surface of said convex portion, and an opening of said second step-recess part is formed on the bottom of said second step-recess part;

the bottoms of said first and second step-recess parts are respectively formed by surfaces that are substantially normal to the axis of said orifice;

said orifice is formed so that the outlet of said orifice opens the bottom of said second step-recess part;

said fuel injection valve has plural sets each of which comprises said stepped recess and said orifice;

said orifices are inclined relative to each other; and at least two of said plural stepped recesses have heights that differ from each other in respective second step-recess parts.

17. The fuel injection valve according to claim 16, wherein respective angles between center axis lines of at least two of said plural orifices and the axis line of said nozzle differ from each other.

18. The fuel injection valve according to claim 16, wherein said convex portion has a spherical surface.

19. The fuel injection valve according to claim 16, wherein a center axis line of said orifice is deflected from a direction of a normal to said convex portion.

20. The fuel injection valve according to claim 16, wherein the bottoms of said first and second step-recess parts form flat surfaces.

21. The fuel injection valve according to claim 16, wherein said first and second step-recess parts are formed by pressing.

22. A fuel injection valve comprising:

a convex portion formed on an outer end surface of a nozzle body;

a stepped recess formed on said convex portion, which stepped recess has plural step-recess parts; and an orifice forming a fuel nozzle hole which is disposed so that an outlet of said orifice is located at a bottom of said stepped recess; wherein, said orifice is inclined relative to an axis of said nozzle body;

said stepped recess comprises a first step-recess part and a second step-recess part;

said first step-recess part and said second step-recess part are adjacent each other in a direction of an axis of said orifice, and are disposed such that a bottom of said first step-recess part forms a downstream face in a fuel traveling direction in said nozzle body, a bottom of said second step-recess part forms an upstream face in the fuel traveling direction, an opening of said first step-recess is formed on a convex surface of said convex portion, and an opening of said second step-recess part is formed on the bottom of said second step-recess part;

the bottoms of said first and second step-recess parts are respectively formed by surfaces that are substantially normal to the axis of said orifice;

said orifice is formed so that the outlet of said orifice opens the bottom of said second step-recess part; and a height of said first step-recess part varies in a circumferential direction of said first step-recess part.

23. The fuel injection valve according to claim 22, wherein a height of said second step-recess part is substantially constant in the circumferential direction of said second step-recess part.

24. The fuel injection valve according to claim 22, wherein said convex portion has a spherical surface.

25. The fuel injection valve according to claim 22, wherein a center axis line of said orifice is deflected from a direction of a normal to said convex portion.

26. The fuel injection valve according to claim 22, wherein the bottoms of said first and second step-recess parts form flat surfaces.

27. The fuel injection valve according to claim 22, wherein said first and second step-recess parts are formed by pressing.

28. A fuel injection valve comprising:

a convex portion formed on an outer end surface of a nozzle body;

a stepped recess formed on said convex portion, which stepped recess has plural step-recess parts; and an orifice forming a fuel nozzle hole which is disposed so that an outlet of said orifice is located at a bottom of said stepped recess; wherein, said orifice is inclined relative to an axis of said nozzle body;

said stepped recess comprises a first step-recess part and a second step-recess part;

said first step-recess part and said second step-recess part are adjacent each other in a direction of an axis of said orifice, and are disposed such that a bottom of said first step-recess part forms a downstream face in a fuel traveling direction in said nozzle body, a bottom of said second step-recess part forms an upstream face in the fuel traveling direction, an opening of said first step-recess is formed on a convex surface of said convex portion, and an opening of said second step-recess part is formed on the bottom of said second step-recess part;

the bottoms of said first and second step-recess parts are respectively formed by surfaces that are substantially normal to the axis of said orifice;

said orifice is formed so that the outlet of said orifice opens the bottom of said second step-recess part;

said fuel injection valve has plural sets each of which comprises said stepped recess and said orifice;

said orifices are inclined relative to each other; and a height of said first step-recess part is less than that of said second step-recess part and varies in a circumferential direction of said first step-recess part;

a height of said second step-recess part is substantially constant in the circumferential direction of said second step-recess part; and at least two of said plural stepped recesses have heights that differ from each other in respective second step-recess parts.

29. The fuel injection valve according to claim 28, wherein respective angles between center axis lines of at least two of said plural orifices and the axis line of said nozzle differ from each other.

30. The fuel injection valve according to claim 28, wherein said convex portion has a spherical surface.

31. The fuel injection valve according to claim 28, wherein a center axis line of said orifice is deflected from a direction of a normal to said convex portion.

32. The fuel injection valve according to claim 28, wherein the bottoms of said first and second step-recess parts form flat surfaces.

33. The fuel injection valve according to claim 28, wherein said first and second step-recess parts are formed by pressing.

* * * * *